United States Patent [19]

Carlson et al.

[11] 4,247,209

[45] Jan. 27, 1981

[54] PRINTER RIBBON CARTRIDGE HAVING LAP SPLICED RIBBON AND REINKING MEANS

[75] Inventors: Robert L. Carlson, Chicago, Ill.; Ronald H. Jack, Little Rock, Ark.; Theodore M. Leno, Arlington Heights, Ill.

[73] Assignee: Teletype Corporation, Skokie, Ill.

[21] Appl. No.: 31,659

[22] Filed: Apr. 19, 1979

[51] Int. Cl.[3] ..... B41J 33/10

[52] U.S. Cl. ..... 400/195; 400/196.1; 400/202.4; 156/502

[58] Field of Search ..... 400/194, 195, 196, 196.1, 400/202.4, 238; 156/502, 504; 83/926 J; 242/58.1, 58.5

[56] References Cited

U.S. PATENT DOCUMENTS

| | | | |
|---|---|---|---|
| 948,972 | 2/1910 | Hess | 400/238 |
| 1,234,728 | 7/1917 | Carson | 400/194 X |
| 2,109,254 | 2/1938 | Landgraf | 400/238 X |
| 2,276,324 | 3/1942 | Mann | 400/238 |
| 2,433,446 | 12/1947 | Foster | 156/502 X |
| 3,408,726 | 11/1968 | Brown | 156/502 X |
| 3,460,666 | 8/1969 | Ploeger | 400/195 |
| 3,561,581 | 2/1971 | Takenaka | 400/194 X |
| 3,874,963 | 4/1975 | Barger | 242/58.5 X |
| 3,981,387 | 9/1976 | Gottschlich | 400/196 |
| 3,989,132 | 11/1976 | Carson | 400/235.1 X |
| 4,018,955 | 4/1977 | Klauke et al. | 400/194 X |

FOREIGN PATENT DOCUMENTS

| | | | |
|---|---|---|---|
| 2550305 | 5/1977 | Fed. Rep. of Germany | 400/196.1 |
| 2332136 | 6/1977 | France | 400/196.1 |
| 806771 | 12/1958 | United Kingdom | 400/194 |

*Primary Examiner*—Ernest T. Wright, Jr.

*Attorney, Agent, or Firm*—John C. Albrecht; A. A. Tirva

[57] ABSTRACT

A printer ribbon cartridge arranged to house an endless band of ribbon formed in a mobius loop which enables different halves of the width of the ribbon to be presented for printing during successive cycles of the ribbon past a printing position.

The ends of the ribbon are joined in a lap splice so that the cut end of the half of the ribbon presented for printing trails as it passes the printing position.

6 Claims, 4 Drawing Figures

PRINTER RIBBON CARTRIDGE HAVING LAP SPLICED RIBBON AND REINKING MEANS

DESCRIPTION

1. Technical Field

This invention relates to printer ribbon cartridges housing endless printer ribbon bands and more particularly to splices for joining at least two ends of a ribbon to form an endless band.

2. Background Art

Printer ribbon cartridges are well-known and include a wide variety of ribbon cartridges usable in various types of printers. Cartridges are used because of the convenience they offer. A well-designed cartridge is easily and quickly installed in a printer without the need for the operator to come into contact with the ribbon and thus eliminates the spreading of ink or other printing medium on the operator's hands and clothing.

During the early days in the development of the printer ribbon cartridges, the ribbon in a cartridge could only be used once. That is, after the ribbon had been pulled out once it was used up and the entire cartridge and ribbon combination had to be replaced. This, of course was quite inconvenient and expensive. Further development resulted in a cartridge utilizing an endless band of ribbon. One such type of endless band is formed in a mobius loop. The advantage of forming a ribbon in a mobius loop is that the upper half front portion of the ribbon during one cycle, becomes the lower rear portion of the ribbon during the following cycle. Thus, different halves of the width of the ribbon are presented for printing during successive cycles of the ribbon past a printing station. This arrangement substantially prolongs the life of a printer ribbon.

The nature of the mobius loop, which as discussed above advantageously prolongs the life of the ribbon, presents a major problem in that a conventional lap-type splice, which is strong and durable, cannot be used to join the free ends of the ribbon to form the loop. The reason is that when a conventional lap-type splice is used every other time the splice passes a printing position, the cut edge of the splice will lead and thus will be subject to getting caught by a type pallet, or the like, resulting in a tear and eventually in a failure of the splice. To prevent this, manufacturers of ribbon cartridges utilizing ribbons formed in mobius loops use a conventional butt-type splice to join the free ends of a ribbon into the loop. The butt-type splice, however, is brittle and fails after it is repeatedly subjected to the impact of type pallets or the like. Thus in most cases, life of the printer ribbon is not limited by the life of the ribbon itself, but rather by the life of the splice used to join the free ends of the ribbon.

DISCLOSURE OF THE INVENTION

In accordance with the present invention, we provide a printed ribbon cartridge in which an endless band of ribbon is formed in a mobius loop enabling different halves of the width of the ribbon to be presented for printing during successive cycles past a printing position. The mobius loop is formed by joining at least the first and second ends of the ribbon in a lap-type splice formed so that the cut edge of the half of the ribbon presented for printing is trailing as it passes the printing position.

THE DRAWING

Figure 3:
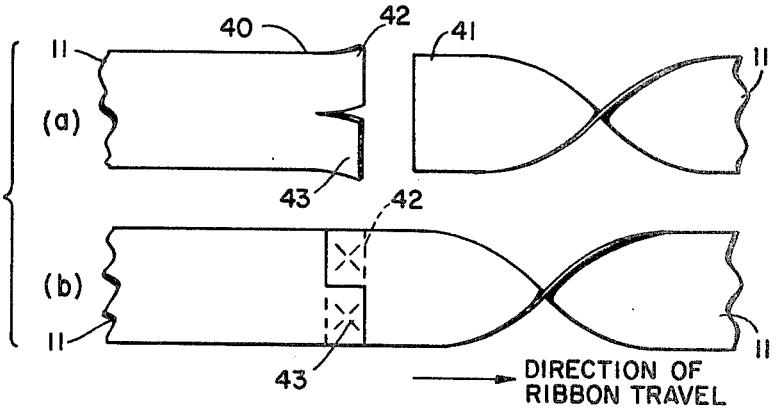

FIGS. 3*a* and 3*b* show an illustrative embodiment of the invention.

Figure 4:
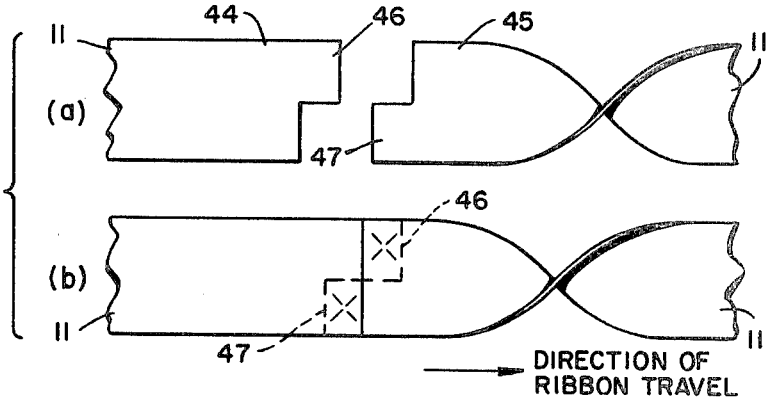

FIGS. 4*a* and 4*b* show an alternative embodiment of the invention.

DETAILED DESCRIPTION

Figure 1:
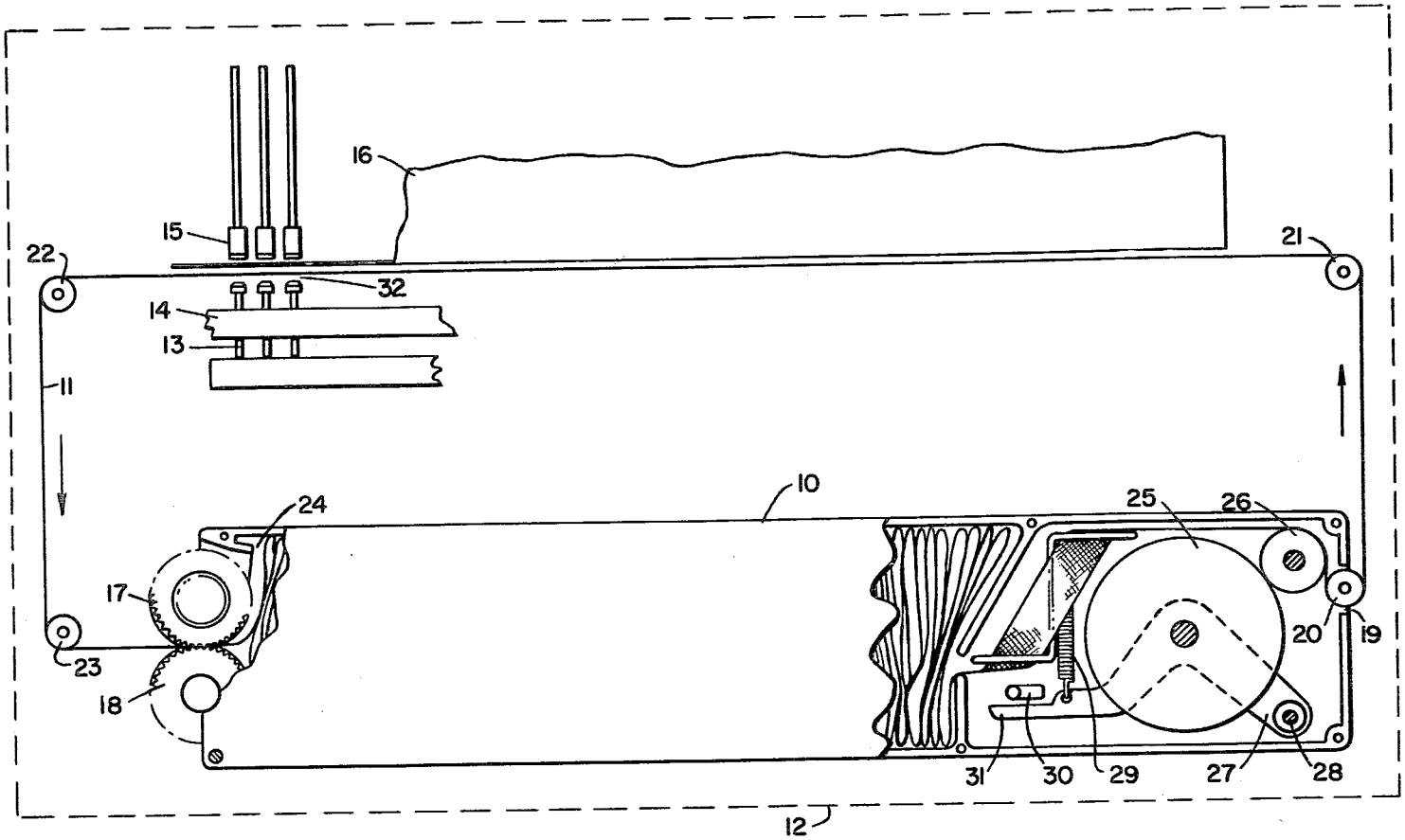
FIG. 1 shows a generalized view of the top portion of a printer and a partially cut-away view of a cartridge housing a printer ribbon formed in a mobius loop.
Figure 2:
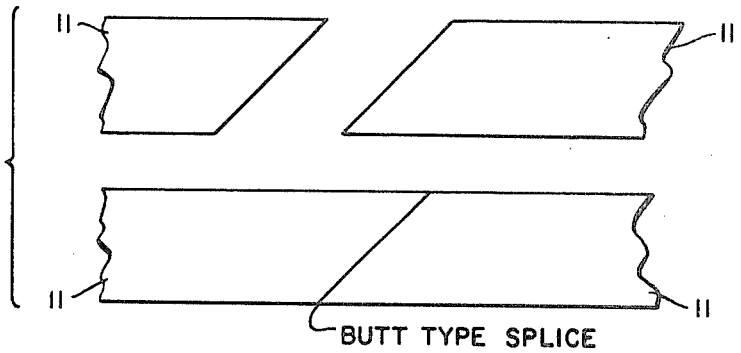
FIG. 2 PRIOR ART
FIG. 2 illustrates a typical prior art butt-type printer ribbon splice.

In FIG. 1 there is shown a cut-away top view of a ribbon cartridge 10 which holds and guides an endless-band-type ribbon 11 for use in a printer, typewriter, printing terminal or the like 12. The ribbon 11 is made of nylon, but any other material suitable for holding or retaining an ink supply can be used.

The specific printer 12 illustrated may be of the type wherein the character or font dies 13 (type pallets) are mounted on a continuously moving endless carrier 14 drawn past an aligned array of printing hammers 15. Interposed between the dies 13 and printing hammers 15 is a record medium 16 on which characters are to be printed, and the inked (or carbon impregnated) ribbon 11 which may be continuously or intermittently moved in one direction past a printing position 32 defined by the aligned array of the printing hammers 15.

Unidirectional movement of the ribbon band 11 past the printing position 32 is facilitated in the printer 12 by a pair of ratchet wheels 17 and 18. Both wheels 17 and 18 are preferably made of plastic and are rotatably mounted on cartridge 10. The two wheels 17 and 18 are sufficiently close together so that their teeth exert a substantially positive grip on the ribbon 11. Ratchet wheel 17 is connected to a driving mechanism (not shown) which may be adjusted to rotate the wheel 17 in a continuous or an intermittent basis.

As the ratchet wheel 17 rotates, the ribbon 11 is gripped by the wheels 17 and 18 which pull the ribbon 11 from the right side of the cartridge 10 through an opening 19 and around a guide roller 20. The ribbon 11 is then guided around guide rollers 21 and 22 which position the ribbon 11 in the printing position 32 between the character dies 13 and the record medium 16. The ribbon 11 is then guided around a guide roller 23 and is pushed by ratchet wheels 17 and 18 back into a partially shown storage compartment 24 located in cartridge 10. As the ribbon 11 is pushed into the storage compartment 24, it tends to follow the periphery of wheel 17 until it comes up against the side of the cartridge 10 closest to wheel 17. At that time the ribbon 11 folds and is pushed down by the wheel 18 against the opposite side of the cartridge 10. This is repeated many times and results in a well-known accordion-type stuffing of the printer ribbon 11 into the storage compartment 24.

If desired, re-inking facilitates may be included in the cartridge 10. Specifically, in the right hand of the cartridge 10 an inking roll 25 and a transfer roll 26 may be rotatably mounted. The inking roll 25 has a larger diameter than the transfer roll 26 and is made of a cellular material such as urethane foam which is capable of holding a supply of printer ink. The inking roll 25 is rotatably mounted on a lever 27 which is itself pivotable around a pivot pin 28 which pin 28 is held in a conformed pocket (not shown) formed as a portion of the cartridge 10. A tension spring 29 attached both to the pivot lever 27 and a side wall of the cartridge 10 constantly urges the inking roll 25 against the transfer roll 26.

Before exiting from the cartridge 10, the ribbon 11 is guided around the transfer roll 26 thereby rotating the roll 26 around its axis. This action results in application of ink to ribbon 11. Since the transfer roll 26 rotates in contact with the inking roll 25, ink is applied by the inking roll 25 to the transfer roll 26.

Whenever there is a sufficient amount of ink on the transfer roll 26, a rotatable lever 30 may be turned so that it pushes against an end 31 of the lever 27 exerting a force against the spring 29 thereby effectively moving inking roll 25 out of contact with the transfer roll 26.

Referring now to FIGS. 3*a* and 3*b* there are shown two free ends 40 and 41 of the printer ribbon 11 before and after they are joined in a lap splice to form the ribbon 11 in a mobius loop. To effect the splice, a slit approximately ¼ inch long is made substantially along the center line of the free end 40 resulting in tabs 42 and 43. The end 41 is then twisted 180 degrees and the two ends 40 and 41 are brought together as illustrated in FIG. 3*b* by placing end 41 into the slit of end 40. When the direction of travel of the ribbon 11 is as shown by the arrow in FIG. 3*b*, the tab 42 is placed behind the solid end 41 and the tab 43 is placed in front of the solid end 41. The overlapping portions of the two ends 40 and 41 of the ribbon 11 are then welded together with uniformly spaced pinpoint welds utilizing an ultrasonic welder. If the ribbon 11 is not made of thermoforming material, such as nylon, an adhesive such as glue may be used to fasten together the overlapping portions of the ribbon 11.

Referring now to FIGS. 4*a* and 4*b*, there is shown an alternative way of joining two free ends 44 and 45 of the printer ribbon 11. Both ends 44 and 45 are cut so that the end 44 has a tab 46 and the end 45 has a tab 47. Each of the tabs 46 and 47 is of a width which is substantially half the width of the ribbon 11, and each tab 46 and 47 extends for approximately ¼ inch. Before joining the two ends 44 and 45, the end 45 is twisted 180 degrees so that the tab 47 is positioned at the bottom half of the ribbon 11. Ends 44 and 45 are then brought together in such a way that tabs 46 and 47 are positioned towards the rear of the ribbon 11. The overlapping portions of the ribbon 11 are then welded together in the same manner as discussed in the welding of the splice shown in FIG. 3*b*.

What is claimed is:

1. A printer ribbon cartridge comprising a housing wherein an endless band of ribbon, formed by joining at least first and second ends of ribbon is stored;

the cartridge being mountable in a printer and arranged to allow a portion of the ribbon to be extended from away the housing for positioning the extended portion of the ribbon adjacent to a printing position in the printer, characterized in that:

the band of ribbon forms a mobius loop enabling different halves of the width of the ribbon to be presented for printing during successive cycles of the ribbon past the printing position, and the first and second ends of the ribbon are joined in a lap splice so that a cut edge of each half of the ribbon being alternately presented for printing is trailing as said ribbon passes the printing position.

2. A printer ribbon cartridge in accordance with claim 1 wherein the lap splice includes the first end of the ribbon having a slit substantially along its center line dividing the first end into first and second substantially equal tabs, the slit accommodates the second end so that the first tab is positioned in a plane located parallel to and behind a plane in which the second end lies and the second tab is positioned in a plane located parallel to and in front of the plane in which the second end lies.

3. A printer ribbon cartridge in accordance with claim 1 wherein the lap splice includes the first and second ends of the ribbon, each end having a tab extending a distance from its end, the tabs being positioned so that the tab extending from the first end is positioned behind the second end, and the tab extending from the second end is positioned behind the first end.

4. A printer ribbon cartridge in accordance with claim 3 wherein the width of each of the tabs is substantially equal to half the width of the ribbon.

5. A printer ribbon cartridge in accordance with claim 1 further comprising a means for reinking the ribbon, wherein the reinking means comprises an inking roll rotatably mounted within the housing and containing a contact-transferable supply of ink;

a transfer roll rotatably mounted within the cartridge;

means for continuously urging the inking roll into contact with the transfer roll;

means for moving the ribbon around the transfer roll whereby the transfer roll is rotated against the inking roll thereby picking up the ink from the inking roll and transferring said ribbon to the ribbon; and means for selectively overriding the urging means whereby the inking roll is kept out of contact with the transfer roll.

6. An impact printer having an endless carrier containing a plurality of type pallets arranged to move the type pallets past an aligned array of printing hammers, the printer including a ribbon cartridge comprising a housing wherein an endless band of ribbon formed by joining at least first and second ends of ribbon is stored;

the cartridge being mountable in the printer and arranged to allow a portion of the ribbon to be extended away from the housing by passing the ribbon over two guide rollers rotatably mounted on the printer for positioning the extended portion of the ribbon in a printing position between said plurality of type pallets located in the carrier and the array of printing hammers;

the band of ribbon forming a mobius loop enabling different halves of the width of the ribbon to be presented for printing during successive cycles of the ribbon past the printing position, characterized in that:

the first and second ends of the ribbon are joined in a lap splice so that a cut edge of each half of the ribbon being alternately presented for printing is trailing as said ribbon passes the printing position.

* * * * *